US005894993A

United States Patent [19]

Takayama et al.

[11] Patent Number: 5,894,993

[45] Date of Patent: Apr. 20, 1999

[54] ROTARY ATOMIZATION HEAD

[75] Inventors: Shinichi Takayama; Masatoshi Kon; Shogo Ikeda, all of Tokyo, Japan

[73] Assignee: ABB Industry K.K., Tokyo, Japan

[21] Appl. No.: 09/068,997

[22] PCT Filed: Sep. 24, 1997

[86] PCT No.: PCT/JP97/03393

§ 371 Date: May 28, 1998

§ 102(e) Date: May 28, 1998

[87] PCT Pub. No.: WO98/14278

PCT Pub. Date: Apr. 9, 1998

[30] Foreign Application Priority Data

Oct. 1, 1996 [JP] Japan ..... 8-279933

[51] Int. Cl.[6] ..... B05B 15/02; F23D 11/34

[52] U.S. Cl. ..... 239/112; 239/223

[58] Field of Search ..... 239/112, 113, 239/223, 224, DIG. 14

[56] References Cited

U.S. PATENT DOCUMENTS 5,078,321 1/1992 Davis et al. ..... 239/224
5,106,025 4/1992 Giroux et al. ..... 239/703
5,163,625 11/1992 Takayama et al. ..... 239/690.1
5,765,762 6/1998 Lee et al. ..... 239/703
5,775,598 7/1998 Takayama et al. ..... 239/703

*Primary Examiner*—Andres Kashnikow
*Assistant Examiner*—Jorge S. Bocanegra
*Attorney, Agent, or Firm*—Oblon, Spivak, McClelland, Maier & Neustadt, P.C.

[57] ABSTRACT

A rotary atomizing head assembly of the present invention is capable of washing off paint deposits from outer peripheral surface of a bell cup in a reliable manner. A paint reservoir (15) which is provided on a bell cup (11) is communicated with the outer peripheral surface of the bell cup (11) through solvent passages (16), and an annular guide (17) is provided around the outer peripheral side of the bell cup (11). Therefore, at the time washing the rotary atomizing head assembly (10), a thinner which is spouted out from a nozzle (6) is introduced into a solvent diffusing chamber (18) which is formed between the bell cup (11) and a enlarged front portion (17B) of the annular guide (17), through the paint reservoir (15) and solvent passages (16). After being diffused around the entire circumference of the bell cup (11) within the solvent diffusing chamber (18), the thinner is allowed to flow along the outer peripheral surface (11H) toward releasing edge (11D) at the fore end of the bell cup (11), washing away paint deposits from the outer peripheral surface (11H) of the bell cup (11).

7 Claims, 11 Drawing Sheets

ROTARY ATOMIZATION HEAD

TECHNICAL FIELD

This invention relates to a rotary atomizing head assembly particularly suitable for use on a-coating machine with color changing functions Generally speaking, electrostatic coating machines with a rotary atomizing head assembly are largely constituted by; a coating machine body; a rotational shaft which is axially extended and rotatably supported on the coating machine body; an air motor which is mounted on the coating machine body for driving the rotational shaft; a rotary atomizing head assembly which is mounted in a fore distal end portion of the rotational shaft and driven from the air motor for rotation on the front side of the coating machine body; and a feed nozzle which is received in the rotational shaft with its fore end portion extended into the rotary atomizing head assembly The feed nozzle which serves for spurting a paint or a thinner as a washing solvent into the rotary atomizing head assembly, is connected to a color changing valve device and a thinner source through pipings.

The rotary atomizing head assembly is formed in a bell- or cup-like shape, including; a bell cup providing a paint spreading surface for spreading a paint into a-thin filmy form and a paint receiving surface in fore and rear portions of its inner peripheral surface, respectively; a hub member mounted on the inner peripheral side of the bell cup between the paint spreading surface and the paint receiving surface; a paint reservoir formed between the rear surface of the hub member and the paint receiving surface of the bell cup for temporarily holding a paint or solvent which is supplied to the paint receiving surface from a feed nozzle provided on the coating machine body; and a plural number of paint outlet holes provided in the hub member, for letting the paint or solvent in the paint reservoir flow out therethrough onto the paint spreading surface of the bell cup.

In a paint coating operation by a prior art electrostatic coating machine of this sort, compressed air is supplied to the air motor in the first place to put the rotational shaft and rotary atomizing head assembly in high speed rotation. Thereafter, a paint is spurted into the rotary atomizing head assembly through the feed nozzle, whereupon the supplied paint is spread into a thin filmy form on the paint forming surface on the inner peripheral side of the bell cup and then released in the form of charged particles from at marginal edge of the rotary atomizing head assembly. At this time, the charged paint particles, which are released from the rotary atomizing head assembly, are urged to fly toward and deposit on a coating object, by traveling along lines of electric force in electrostatic field which is formed between the electrostatic coating machine and the coating object.

During a paint coating operation by an electrostatic coating machine as described above, paint inevitably deposits on the paint spreading surface as well as on the paint receiving surface of the bell cup. In order to wash paint deposits off the paint spreading surface, it is the usual practice to spurt a thinner onto the bell cup through a feed nozzle while keeping the rotational shaft and the rotary atomizing head assembly in rotation by the air motor. Consequently, the thinner is spread over inner peripheral surface of the bell cup and urged to flow toward the paint releasing edge through the paint spreading surface, washing away paint deposits therefrom With a prior art electrostatic coating machine of this type, paint particles which are released from the paint releasing edge at the fore end of a bell cup are mostly put on a flight toward a coating object along lines of electric force to deposit on the coating object However, it is often the case that part of released paint particles tend to flow in a reverse direction toward the outer peripheral side of the bell cup and deposit on outer peripheral surface of the bell cup.

Namely, when the rotary atomizing head assembly is put in high speed rotation, it is known in the art that inverse air flows are induced by the air-pumping phenomenon, in which air is sucked into a negative pressure region which occurs on the front side of the bell cup under the influence of the high speed rotation of the rotary atomizing head assembly. As a consequence, part of released paint particles are entrained on inverse air flows toward rear side of the bell cup. In addition, in some cases shaping air is spurted out from the rotary atomizing head assembly to shape the spray of paint particles into a desired pattern. In such a case, negative pressure regions are also developed partly around the outer peripheral side of the bell cup under the influence of the jets of shaping air, also causing part of released paint particles to flow in an inverse direction or toward the rear side of the bell cup.

In case paint particles are partly entrained on inverse air flows in this manner, the paint particles deposit on outer peripheral surface of the bell cup and remain there in a solidified state. Therefore, under certain conditions of coating operation, solidified paint falls off in small fragments which can detrimentally impair the quality of end products by depositing on coated surface. Further, according to the prior art electrostatic coating machine, the paint receiving and spreading surfaces of the bell cup are washed with a thinner which is spurted out toward the inner peripheral side of the bell cup from the afore-mentioned feed nozzle. However, difficulties are often experienced in removing paint deposits from the outer peripheral surface of the bell cup simply by supplying a thinner through a feed nozzle in such a manner.

In this connection, in an attempt to solve the problem just mentioned, Japanese Utility Model Laid-Open No. S57-62659 (hereinafter referred to as "other prior art" for brevity) discloses an electrostatic coating machine employing a feed nozzle which is arranged to spurt a thinner toward the outer peripheral surface of a bell cup. According to other prior art electrostatic coating machine, while a rotary atomizing head assembly is being kept in rotation, a thinner is spurted onto the outer peripheral surface of the bell cup from a feed nozzle which is provided on a coating machine body, thereby washing away and removing deposited paint therefrom Nevertheless, according to the above-mentioned other prior art, a thinner is simply spurted toward the outer peripheral surface of the bell cup just for washing the outer peripheral side of the rotary atomizing head assembly, which is kept in rotation. Therefore, the thinner mostly is instantly shaken off the outer peripheral surface without contacting the surface of the bell cup in a sufficient degree in affinity or intimacy which is necessary for washing away paint deposits in a reliable manner.

In order to wash away paint deposits from outer peripheral surface of the bell cup in a more reliable manner, free of the above-mentioned problems of the thinner being splashed around without contacting outer peripheral surface of the bell cup in a sufficient degree, it is necessary to determine the position and direction of a wash feed nozzle precisely and elaborately in relation with a thinner feed rate through engineering processes which require extremely sophisticated machine designing and production technology.

Further, in view of complication in construction and increases in the number of machine parts and production cost, it is inefficient and uneconomical to provide a wash feed nozzle exclusively for the purpose of washing outer peripheral surface of a bell cup in addition to a feed nozzle which is fitted in a rotational shaft of the rotary atomizing head assembly for spurting a thinner toward inner peripheral surface of the bell cup as in the above-described prior art electrostatic coating machine.

DISCLOSURE OF THE INVENTION

With the above-mentioned problems of the prior art in view, it is an object of the present invention to provide a rotary atomizing head assembly which can wash away paint deposits from outer peripheral surface of a bell cup efficiently in a reliable manner.

In accordance with the present invention, as a solution to the problems of the prior art as described above, there is provided a rotary atomizing head assembly which basically includes; a bell cup formed in a bell- or cup-shape, and having a paint spreading surface in a front portion of its inner peripheral surface thereof for spreading a paint into a thin filmy form and a paint receiving surface in a rear portion of the inner peripheral surface; a hub member mounted on the inner peripheral side of the bell cup between the paint spreading surface and the paint receiving surface; a paint reservoir formed between a rear surface of the hub member and the paint receiving surface of the bell cup for holding a supply of paint or solvent received from a nozzle provided on a coating machine body; and a plural number of paint outlet holes provided in the hub member, for letting the paint or solvent flow out from the paint reservoir onto the paint spreading surface on the inner peripheral side of the bell cup.

The rotary atomizing head assembly according to the present invention is characterized by the provision of; a plural number of solvent passages having respective entrance and exit openings located on the inner and outer peripheral surfaces of the bell cup, respectively, to communicate the paint reservoir with the outer peripheral side of the bell cup; an annular guide mounted around the bell cup in spaced relation with the outer peripheral side of said bell cup to guide effluent solvent from the exit openings of the solvent passages; and a solvent diffusing chamber formed between and around the inner peripheral surface of the annular guide and outer peripheral surface of the bell cup to diffuse the solvent supplied thereto through the solvent passages.

With the arrangements just described, at the time of a coating operation, a paint is supplied to the paint reservoir through the above-mentioned nozzle while rotating the rotary atomizing head assembly at a predetermined speed. Consequently, under the influence of centrifugal force, the paint supplied to the paint reservoir is diffused within the paint reservoir and urged to flow out to the paint spreading surface on the bell cup through the paint outlet holes which are provided in the hub member. After being spread into a thin filmy form, the paint is released in the form of atomized particles at the fore end of the bell cup. Then, under the influence of electrostatic force, released paint particles are urged to fly toward and deposit on a coating object. In such a coating operation, the paint, which has a higher viscosity as compared with solvent, is entirely led into the paint outlet holes without entering the solvent passages.

For changing the paint color upon finishing a coating operation with a certain color, it is necessary to wash the rotary atomizing head assembly to remove paint deposits of previous color. In order to carry out a washing operation for this purpose, a solvent is spurted into the paint reservoir from a solvent feed nozzle while holding the rotary atomizing head assembly in rotation By so doing, the solvent is diffused within the paint reservoir under the influence of centrifugal force, and part of the solvent in the paint reservoir is urged to flow out through the paint outlet holes to the paint spreading surface and released from releasing edge at the fore end of the bell cup, thereby washing and carrying away paint deposits of previous color from the paint spreading surface.

On the other hand, due to low viscosity, the residue of the solvent which has been diffused within the paint reservoir is introduced into the entrance openings of the solvent passages which lead to the outer peripheral side of the bell cup. Effluent solvent, which flows out of the exit openings of the solvent passages, is spread over and around the entire outer peripheral surface of the bell cup within the solvent diffusing chamber. Further, the solvent within the solvent diffusing chamber is guided toward the fore end of the bell cup by the annular guide and at the same time spattered on outer peripheral surface in a front portion of the bell cup. As a result, paint deposits of previous color on the outer peripheral surface in a front portion of the bell cup are washed away with the solvent.

According to one preferred form of the present invention, an annular ridge or protuberance is provided in the solvent diffusing chamber between inner peripheral surface of the annular guide and outer peripheral surface of the bell cup for the purpose of dispersing flow of the solvent over and around the entire outer peripheral side of the bell cup within the solvent diffusing chamber.

With the arrangements just described, at the time of washing the rotary atomizing head assembly, a solvent is spurted into the paint reservoir from a nozzle, and then introduced into the solvent diffusing chamber through the respective solvent passages. The solvent which flows through the solvent diffusing chamber is temporarily stopped by the annular protuberance and dispersed over and around the entire solvent diffusing chamber. As a consequence, the solvent in the solvent diffusing chamber is dispersed over and around the entire outer peripheral side of the bell cup, and then allowed to flow out toward outer peripheral surface in a front portion of the bell cup to wash away paint deposits from entire outer peripheral surface of the bell cup.

In this instance, an annular protuberance may be provided on the inner peripheral surface of the annular guide and projected toward the outer peripheral surface of the bell cup to form an annular constricted passage between the annular guide and the bell cup.

With the arrangements just described, at the time of washing the rotary atomizing head assembly, a solvent which is spurted into the paint reservoir through a solvent feed nozzle is introduced into the solvent diffusing chamber through the solvent passages. Then, the solvent is urged to flow toward the fore end of the bell cup under the guidance of the annular guide, and collided against the projecting annular protuberance on the inner peripheral surface of the annular guide. As a result, the solvent is dispersed over and around the entire circumference of the bell cup within the solvent diffusing chamber. In this manner, the annular protuberance functions as a dam or weir for temporarily stopping the forward flow of the solvent within the solvent diffusing chamber. After being dispersed over and around the entire circumference of the bell cup, the solvent within the solvent diffusing chamber is then allowed to flow out through the annular constricted passage to outer peripheral surface of the bell cup on the front side of the annular protuberance to wash away paint deposits from the outer peripheral surface of the bell cup.

Alternatively, an annular protuberance may be provided on the outer peripheral surface of the bell cup in such a way as to project outwardly toward the inner peripheral surface of the annular guide, thereby forming an annular constricted passage between the annular guide and the bell cup.

With the arrangements just described, the solvent which is introduced into the solvent diffusing chamber at the time of atomizing head assembly washing operation can be similarly dispersed over and around the entire circumference of the bell cup thanks to the dam effects of the annular protuberance. It follows that paint deposits on the outer peripheral surface of the bell cup can be washed away with the solvent.

According to another preferred form of the present invention, the entrance openings of the solvent passages are located in positions inwardly spaced from the paint outlet holes by a predetermined distance.

With the arrangements just described, a paint which is spurted into the paint reservoir through a nozzle during coating operation is urged to flow along rear surface of the hub member toward the paint outlet holes, without entering the solvent passages which are opened in positions rearwardly spaced from the respective paint outlet holes. On the other hand, at the time of atomizing head washing operation, a solvent which is spurted into the paint reservoir through a nozzle is widely dispersed within the paint reservoir because of low viscosity as compared with the paint, and urged to flow readily into the respective solvent passages.

According to the present invention, preferably the solvent passages are inclined in the rotational direction of the bell cup gradually from entrance openings toward exit openings thereof.

With the arrangements just described, the solvent, which is introduced into the paint reservoir through a nozzle at the time of atomizing head washing operation, can be introduced into the solvent passages more readily. Namely, since the bell cup is put in rotation in a predetermined direction during a rotary atomizing head assembly washing operation, the solvent which has been introduced into the paint reservoir through a nozzle tends to swirl in the rotational direction of the bell cup. In this instance, the solvent can be urged to enter the respective solvent passages more readily since the inclination of the solvent passages is related with the flow direction of the solvent swirling in the paint reservoir.

Further, according to the present invention, the respective solvent passages are preferably inclined in a direction rearward of the bell cup gradually from the entrance openings toward the exit openings thereof.

With the arrangements just described, by inclination of the solvent passages toward the rear side of the bell cup, the respective solvent passages are extended in a direction different from centrifugal directions (radial directions) of the bell cup. Therefore, even if a paint, which is fed to the paint reservoir through a paint nozzle, is diffused in centrifugal directions during a coating operation under the influence of centrifugal force by high speed rotation of the bell cup, there is no possibility of the paint entering the solvent passages.

On the other hand, the solvent, which is lower than paint in viscosity, has properties of easily passing through narrow ducts. Therefore, at the time of washing the rotary atomizing head assembly, the solvent, which has been supplied to the paint reservoir through a nozzle, can readily flow into the respective solvent passages.

BEST MODE FOR CARRYING OUT THE INVENTION

Hereafter, the present invention is described more particularly by way of its preferred embodiments with reference to the accompanying drawings.

Shown in FIGS. 1 through 4 is an electrostatic coating machine employing a rotary atomizing head assembly, which is according to a first embodiment of the present invention.

Figure 1:
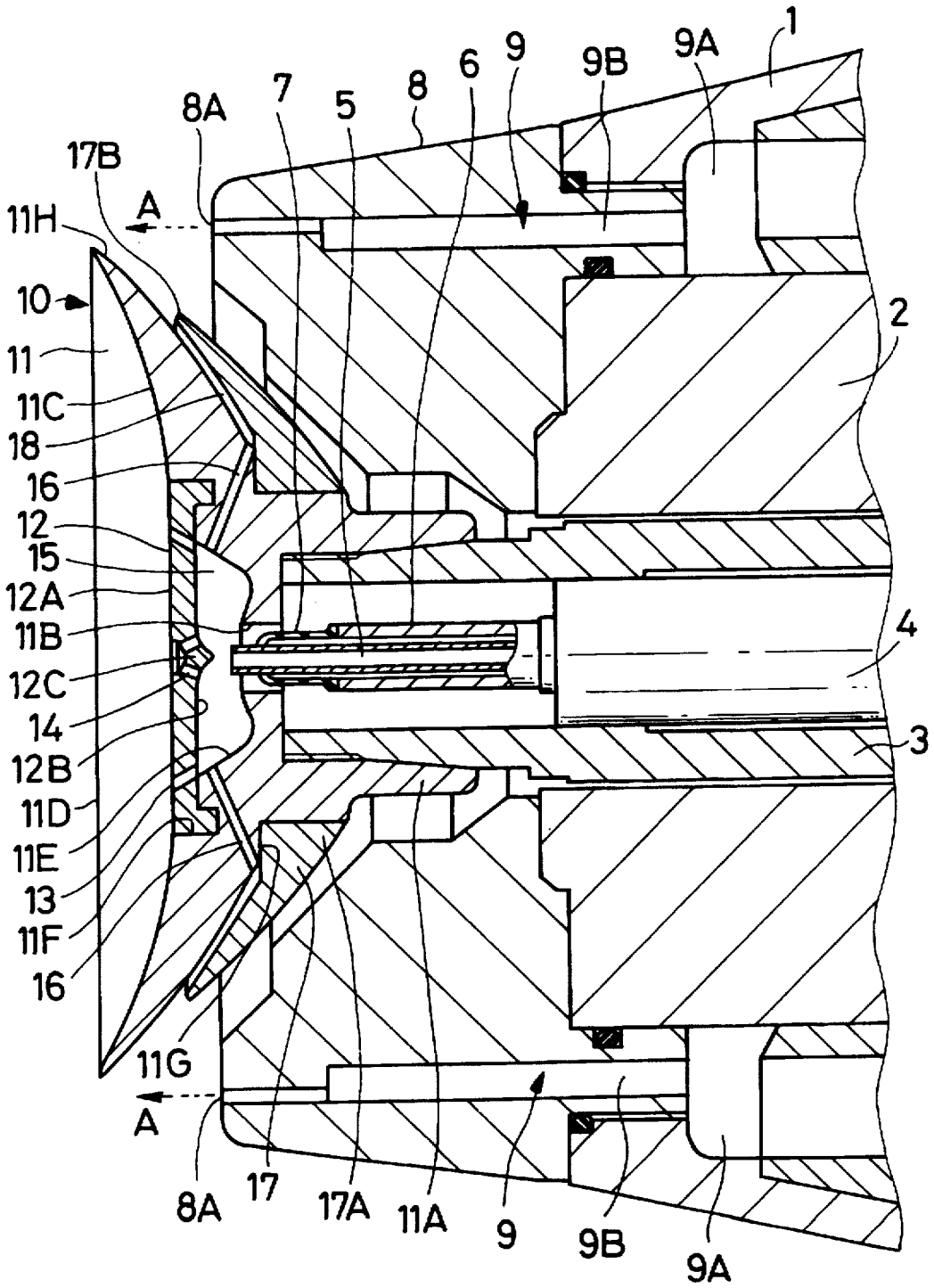
FIG. 1 is a longitudinal section of a rotary atomizing head assembly according to a first embodiment of the present invention, showing the rotary atomizing head assembly along with a rotational shaft and a shaping air ring.

In FIG. 1, indicated at 1 is a cover which forms the outer configuration of the electrostatic coating machine. Encased in the cover 1 are an air motor 2, and a hollow rotational shaft 3 which is put in high speed rotation by the air motor 2.

Denoted at 4 is a feed tube which is passed through the rotational shaft 3. This feed tube 4 is provided with a paint feed nozzle 5 and a solvent feed nozzle 6.

In this particular embodiment, the paint feed nozzle 5 has its base end connected to a paint source through a paint valve or the like (both not shown in the drawings), and has its fore end protruded forward from the fore distal end of the rotational shaft 3 and extended into a rotary atomizing head assembly 10 which will be described hereinafter. A paint is supplied to the rotary atomizing head assembly 10 through the paint feed nozzle 5.

On the other hand, the solvent feed nozzle 6 is provided coaxially around the paint feed nozzle 5. The solvent feed nozzle 6 has its rear end connected to a solvent source through a solvent valve or the like (both not shown in the drawings), and has its fore end located at the fore end of the rotational shaft 3 which is extended into the rotary atomizing head assembly 10. A check valve 7 which is constituted by a resilient valve member or the like, is provided at the fore end of the solvent feed nozzle 6. When the solvent valve is opened for washing the rotary atomizing head assembly 10, a solvent or thinner is fed to the solvent feed nozzle 6 under pressure, and introduced into the rotary atomizing head assembly 10 as soon as the check valve 7 is opened by the pressure of the thinner.

Indicated at 8 is a shaping air ring which is provided at the fore end of the cover 1. The shaping air ring 8 is formed substantially in a cylindrical shape, and provided with a plural number of shaping air outlet holes 8A which are arranged annularly or circularly on its fore end face.

Designated at 9 is a shaping air supply passage, and this passage 9 is including an air passage 9A which is formed in the cover 1 and an air passage 9B which is formed in the shaping air ring 8, and supplied with shaping air from an air source (not shown) to send the shaping air toward the shaping air outlet holes 8A.

In this instance, shaping air is blown out through the shaping air outlet holes 8A in the direction of arrow A to shape the spray of released paint particles into a predetermined pattern. As will be described hereinafter, shaping air also serves to restrict flow directions of a thinner, which flows out through solvent passages 16 on the bell cup 11, blowing the thinner against outer peripheral surface 11H of the bell cup 11.

Figure 2:
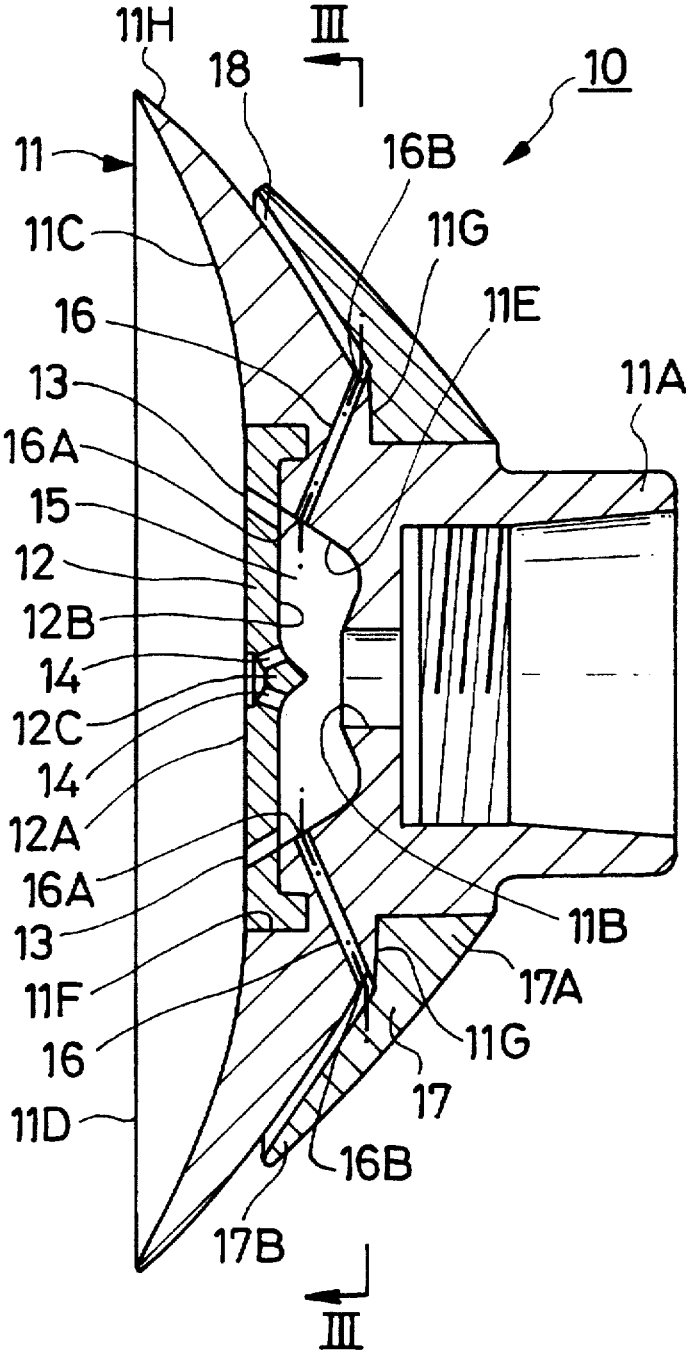
FIG. 2 is a longitudinal section of the rotary atomizing head assembly shown in FIG. 1.

Indicated at 10 is the rotary atomizing head assembly which is mounted on the rotational shaft 3. As shown in FIG. 2, the bell cup 11, which defines the outer configuration of the rotary atomizing head assembly 10, is formed in a bell- or cup-like shape enlarging the forward direction from a fitting base portion 11A to be mounted on a fore end portion of the rotational shaft 3 through threaded engagement therewith. Formed centrally of the bell cup 11 is a passage hole 11B of a small diameter for receiving therein the paint feed nozzle 5 and the check valve 7 of the solvent feed nozzle 6, which are protruded forward from the fore distal end of the rotational shaft 3.

Further, also on the inner peripheral side, the bell cup 11 is gradually enlarged toward its front end from the passage hole 11B as the fashion of a skirt, providing a paint spreading surface 11C in a front portion for spreading a supplied paint into a thin filmy form toward paint releasing edge 11D which border the front end of the paint spreading surface lC. A paint receiving surface 11E for receiving either a paint or a thinner which is spouted out through the paint feed nozzle 5 or solvent feed nozzle 6, is provided in a rear portion of the inner peripheral surface of the bell cup 11. Further, a hub mounting groove 11F is formed between the paint spreading surface 11C and paint receiving surface 11E for mounting a hub member 12 which will be described hereinafter. Furthermore, a stepped mount portion 11G is formed in an axially intermediate portion on the outer peripheral side of the bell cup 11.

Indicated at 12 is the hub member which is fitted in the hub mounting groove 11F of the bell cup 11. The hub member 12 is formed in the shape of a disk, and has its center axis located in alignment with the center axis of the rotary atomizing head assembly 10 (or with the axis of the rotational shaft). Further, the hub member 12 is provided with a front face 12A on its front side, which is formed in a flat shape continuously from the paint spreading surface 11C of the bell cup 11, and with a paint supply surface 12B on its rear side. The paint supply surface 12B is provided with a conical projection 12C at the center thereof.

Denoted at 13 are a plural number of paint outlet holes which are arranged annularly or circularly along the outer peripheral side of the hub member 12. Through these paint outlet holes 13, a paint or a solvent, which has been spouted into the inner peripheral side of the bell cup 11 through the paint feed nozzle 5 or the solvent feed nozzle 6, is allowed to flow out onto the paint spreading surface 11C.

Indicated at 14 are a plural number of solvent outlet holes which are bored at the foot of the conical projection 12C through from the paint supply surface 12B to the front face 12A of the hub member 12. At the time of washing the rotary atomizing head assembly 10, a thinner which has been spouted into the inner peripheral side of the bell cup 11 from the solvent supply nozzle 6 is allowed to flow out through these solvent outlet holes 14 to the front face 12A of the hub member 12.

Designated at 15 is a paint reservoir which is formed and defined between the paint supply surface 12B of the hub member 12 and the paint receiving surface 11E of the bell cup 11 when the hub member 12 is mounted in position in engagement with the hub mounting groove 11F on the bell cup 11. This paint reservoir 15 provides a space for spreading and temporarily holding a certain amount of paint or solvent which has been spouted into the bell cup 11 through the paint feed nozzle 5 or solvent feed nozzle 6.

Indicated at 16 are a plural number of solvent passages, for example, twelve solvent passages which are formed at predetermined intervals in the circumferential direction of the bell cup 11. Each one of the solvent passages 16 is radially bored through the bell cup 11 to extend from the inner to the outer peripheral side thereof, with an entrance opening 16A opened on the paint receiving surface 11E and an exit opening 16B opened on the outer peripheral surface 11H of the bell cup 11. At the time of washing the rotary atomizing head assembly 10, a thinner which has been supplied to the paint reservoir 15 through the solvent feed nozzle 6 is allowed to flow into these solvent passages 16 and onto outer peripheral surface of the bell cup 11. Needless to say, there may be provided two to eleven or more than thirteen solvent passages 16 if desired.

Figure 4:
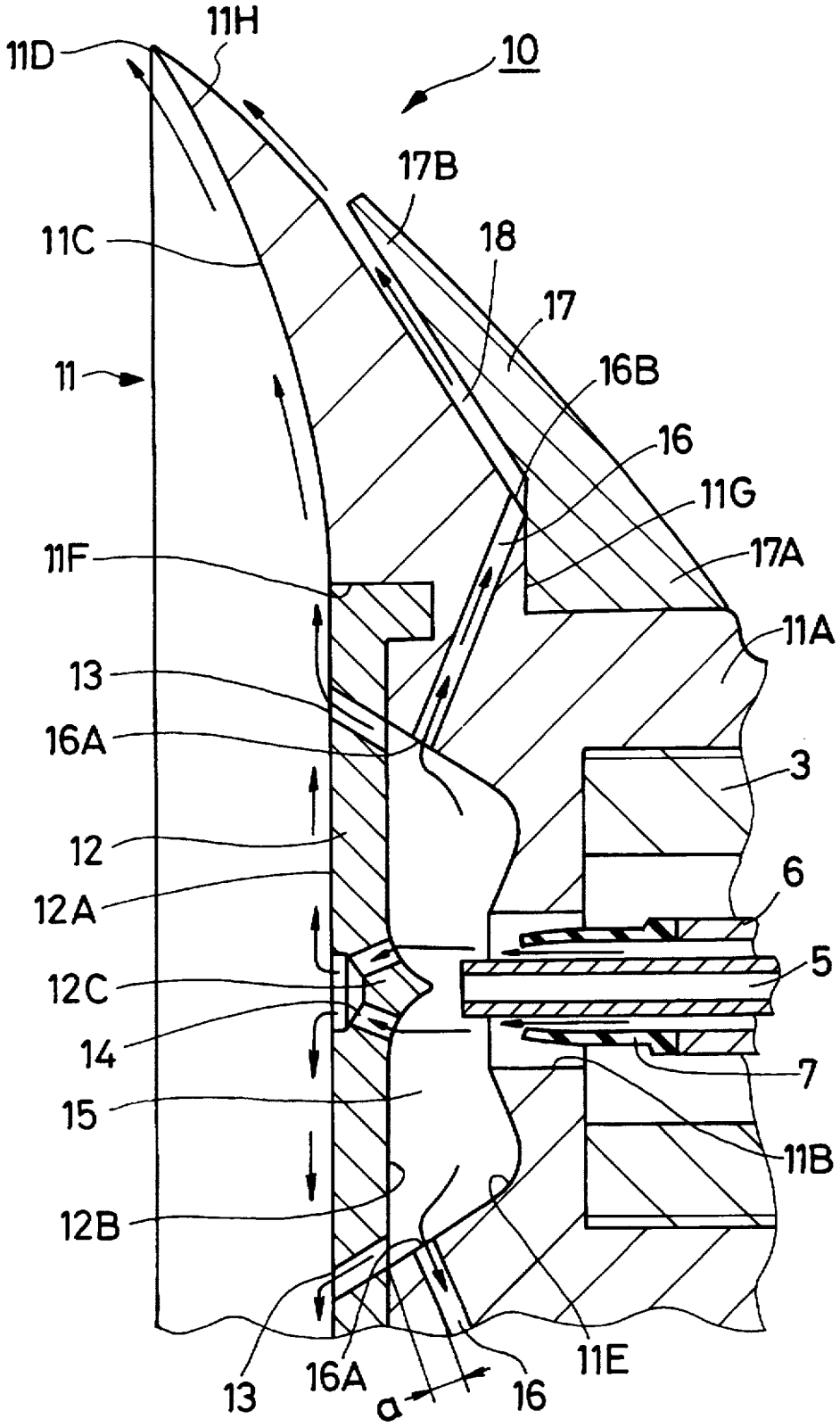
FIG. 4 is an enlarged longitudinal section through major components of the rotary atomizing head assembly of FIG. 1 in a washing operation.

In this particular embodiment, as shown in FIG. 4, the entrance openings 16A of the respective solvent passages 16 are located inward of and at a predetermined distance a from the paint outlet holes 13. Namely, the entrance openings 16A of the solvent passages 16 are opened at positions which are spaced from the paint outlet holes 13 in a direction rearward of the bell cup 11. Consequently, during a coating operation, a paint which is supplied to the paint reservoir 15 through the paint feed nozzle 5 is prevented from flowing into the solvent passages 16. On the other hand, during a washing operation, a thinner which is supplied to the paint reservoir 15 through the solvent feed nozzle 6 is allowed to flow into the solvent passages 16.

Further, from the entrance opening 16A toward the exit opening 16B, each solvent passages 16 is gradually inclined toward the rear side of the bell cup 11. Namely, the exit openings 16B of the solvent passages 16 are located axially rearward of the respective entrance openings 16A for preventing paint from flowing into the solvent passages 16 during coating operations.

Figure 3:
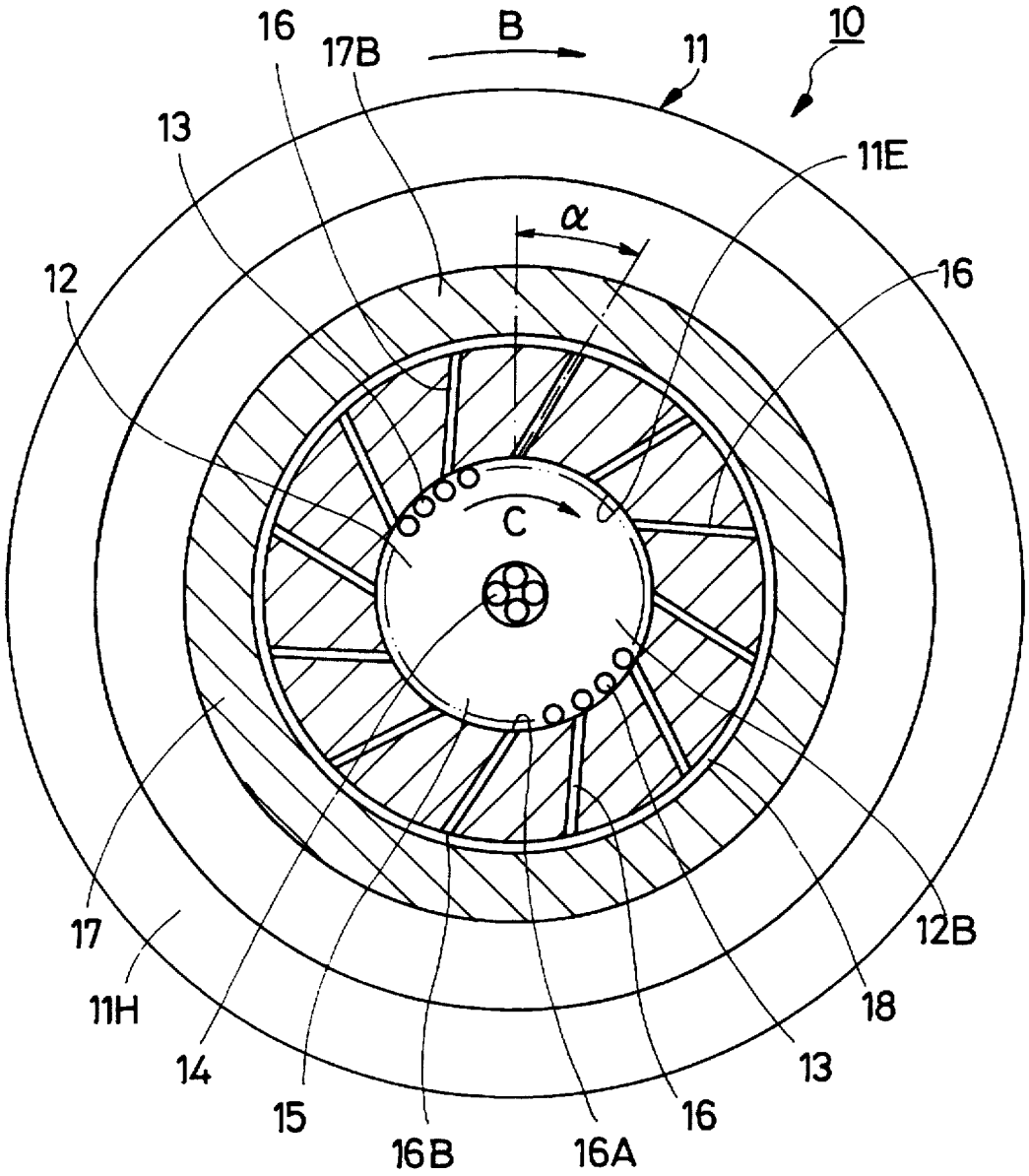
FIG. 3 is a cross-section of the atomizing head assembly, taken in the direction of arrows III—III in FIG. 2.

Besides, as shown in FIG. 3, each solvent passage 16 is twisted in the rotational direction of the rotary atomizing head assembly 10 (in the direction of arrow B), gradually from the entrance opening 16A toward the exit opening 16B. Namely, the respective solvent passages 16 are twisted about the axis of the bell cup 11 through an angle $\alpha$ of from 15° to 50°. This arrangement makes it easier for the thinner to flow into the respective solvent passages 16 after being spouted into the paint reservoir 15 through the solvent feed nozzle 6 during washing operation on the rotary atomizing head assembly 10.

Indicated at 17 is an annular guide which is fitted on the stepped mount portion 11G in a rear portion of the bell cup 11. The annular guide 17 includes a fitting base portion 17A and a spreading or enlarged front portion 17B which spreads in the shape of a bell or cup. In this instance, the annular guide 17 has the base portion 17A securely fixed on the stepped mount portion 11G of the bell cup 11, with the enlarged front portion 17B extended toward the front side of the bell cup 11 in a predetermined spaced relation with outer peripheral surface 11H of the bell cup 11. Namely, the annular guide 17 is located to circumvent the outer peripheral side of the bell cup 11 in a spaced relation with the latter.

Denoted at 18 is a solvent diffusing chamber which is formed between the inner peripheral surface of the enlarged front portion 17B of the annular guide 17 and the outer peripheral surface 11H of the bell cup 11. This solvent diffusing chamber 18 is formed around the entire circumference of the bell cup 11, and the exit openings 16B of the above-described solvent passages 16 are opened into deep bottom portions of this solvent diffusing chamber 18. In a washing operation on the rotary atomizing head assembly 10, a thinner is urged to flow into the solvent passages 16 from the paint reservoir 15 and then into the solvent diffusing chamber 18 through the exit openings 16B of the respective solvent passages 16. Upon flowing into the solvent diffusing chamber 18, the thinner is diffused in circumferential directions.

With the arrangements as described above, the rotary atomizing head assembly 10 of the present embodiment can provide the following functions and performances in paint coating operations.

At the start of a paint coating operation, the rotational shaft 3 is driven from the air motor 2 for rotating the rotary atomizing head assembly 10 at a high speed in the direction of arrow B in FIG. 3, and a paint is introduced into the paint reservoir 15 on the rotary atomizing head assembly 10 through the paint feed nozzle 5. As a result, the paint which has been fed to the paint reservoir 15 is urged to flow out to the paint spreading surface 11C of the bell cup 11 through the respective paint outlet holes 13 and spread into a thin filmy form on the paint spreading surface 11C. At the paint releasing edge 11D, the thin film of paint is thrown forward in the form of liquid threads from the paint releasing edge 11D, and atomized into fine particles.

At this time, since a high voltage is applied across the rotary atomizing head assembly 10 and a coating object, the atomized and charged paint particles, which are released from the rotary atomizing head assembly 10, are urged to fly toward and deposit on a work to be coated. At this time, the spray of paint particles is shaped into a predetermined pattern by shaping air which is spurted out through the respective shaping air outlet holes 8A of the shaping air ring 8.

Paint deposits of a previously used color can be removed from the rotary atomizing head assembly 10 by a washing operation as follows. For washing the rotary atomizing head assembly 10, a thinner is supplied through the solvent feed nozzle 6 to the rotary atomizing head assembly 10, which is put in rotation by the air motor 2 along with the rotational shaft 3. Whereupon, the check valve 7 is opened as shown in FIG. 4, and the thinner is introduced into the paint reservoir 15 through the solvent feed nozzle 6. In the paint reservoir 15, the thinner is diffused and urged to flow into the respective paint outlet holes 13, solvent outlet holes 14 and solvent passages 16 as indicated by arrow in FIG. 4.

In this instance, the thinner which has come out to the front side of the bell cup 11 through the paint outlet holes 13 is spread to flow over and along the entire paint spreading surface 11C of the bell cup 11, so that paint deposits of previously used color are washed away from the paint spreading surface 11C along with the thinner which is eventually released at the paint releasing edge 11D.

On the other hand, the thinner flowing out from the solvent outlet holes 14 is spread and dispersed over the front face 12A of the hub member 12 to wash away paint deposits of previously used color therewith, and the thinner is released from the paint releasing edge 11D of the bell cup 11 after flowing across the paint spreading surface 11C.

Further, the thinner which has entered the solvent passages 16 is directed in radially outward directions on leaving the exit openings 16B of the each solvent passages 16, and then hit against the enlarged front portion 17B of the annular guide 17 and temporarily pooled in the solvent diffusing chamber 18. At this time, the thinner is diffused around the entire circumference of the bell cup 11.

The thinner within the solvent diffusing chamber 18 is then guided toward front portions of the bell cup 11 along the enlarged front portion 17B of the annular guide 17, and allowed to flow toward the fore end of the bell cup 11 from the solvent diffusing chamber 18 to wash away paint deposits of previous color on the outer peripheral surface 11H of the bell cup 11.

Thus, according to this embodiment, for washing the rotary atomizing head assembly 10, a thinner is supplied to the paint reservoir 15 through the solvent supply nozzle 6, and allowed to flow into the solvent diffusing chamber 18 through the respective solvent passages 16, and this thinner is then guided toward front portions of the bell cup 11 by the annular guide 17 and showered on the outer peripheral surface 11H of the bell cup 11 to wash away paint deposits therefrom Further, according to the present embodiment, as shown particularly in FIG. 4, the entrance openings 16A of the respective solvent passages 16 are opened in deeper positions than the paint outlet holes 13, at a distance a from the latter. Therefore, the thinner is urged to flow into the solvent passages 16 during a washing operation, and paint is prevented from flowing into the solvent passages 16 during a coating operation.

Namely, during a coating operation, major part of paint which has been introduced into the paint reservoir 15 flows on and along the paint supply surface 12B of the hub member 12 toward the respective paint outlet holes 13, so that there is little possibility of the paint flowing into the solvent passages 16 which are located in deeper positions than the paint outlet holes 13. Besides, although part of the paint in the paint reservoir 15 is diffused toward the paint receiving surface 11E of the bell cup 11, the paint would not enter the entrance openings 16A of the solvent passages 16 because of its higher viscosity and surface tension as compared with the solvent. In addition, the respective solvent passages 16 which are inclined toward the rear side of the bell cup 11 functions to prevent inflow of the paint.

Further, according to the present embodiment, the provision of the annular guide 17 is arranged to circumvent the outer peripheral side of the bell cup 11, so that, at the time of a washing operation for removing paint deposits of previous color from the rotary atomizing head assembly 10, the thinner which is scattered away from the exit opening 16B of each solvent passage 16 under the influence of centrifugal force is collided against inner peripheral surface of the enlarged front portion 17B of the annular guide 17, thereby temporarily pooling in the solvent diffusing chamber 18. As a result, all of the thinner which comes out through the respective solvent passages 16 is guided toward the front side of the bell cup 11 by the annular guide 17 and showered on the outer peripheral surface 11H of the bell cup 11.

Accordingly, when washing the outer peripheral surface 11H of the bell cup 11 with a thinner for removal of paint deposits therefrom, it becomes possible to use the thinner very efficiently and economically, that is to say, to improve the washing efficiency to a marked degree by consumption of the least amount of thinner.

Further, the thinner which has been introduced into the solvent diffusing chamber 18 through the respective solvent passages 16 is diffused by the annular guide 17 along and over the outer peripheral surface 11H of the bell cup 11 to wash away paint deposits from the entire outer peripheral surface 11H of the bell cup 11.

Moreover, according to the present embodiment having the respective solvent passages 16 inclined with a twist in the rotational direction of the rotary atomizing head assembly 10, a greater amount of thinner can be sent into the solvent passages 16 in a reliable manner at the time of washing the rotary atomizing head assembly 10. Namely, as the rotary atomizing head assembly 10 is rotated in the direction of arrow B, the thinner within the paint reservoir 15 is caused to flow in the same direction as the rotary atomizing head assembly 10 (as indicated by arrow C) due to its viscosity. Consequently, in an assured manner, the thinner is urged to flow into the solvent passages 16 which are twisted in the direction of arrow B. Therefore, a large amount of thinner can be showered on the outer peripheral surface 11H of the bell cup 11 through the solvent passages 16 and solvent diffusing chamber 18, washing away paint deposits on the outer peripheral surface 11H of the bell cup 11 very effectively and reliably.

Furthermore, according to the present embodiment, the above-mentioned excellent washing performance can be achieved simply by providing the solvent passages 16 and annular guide 17 on the bell cup 11. Accordingly, in the case of an electrostatic coating machine of the so-called center feed tube type, it can be realized simply by adding some changes to the rotary atomizing head assembly, without necessitating reconstruction of the coating machine body proper. That is to say, a coating machine can be improved easily to enhance its washing performance quality without entailing increases in cost or complications in construction.

Figure 5:
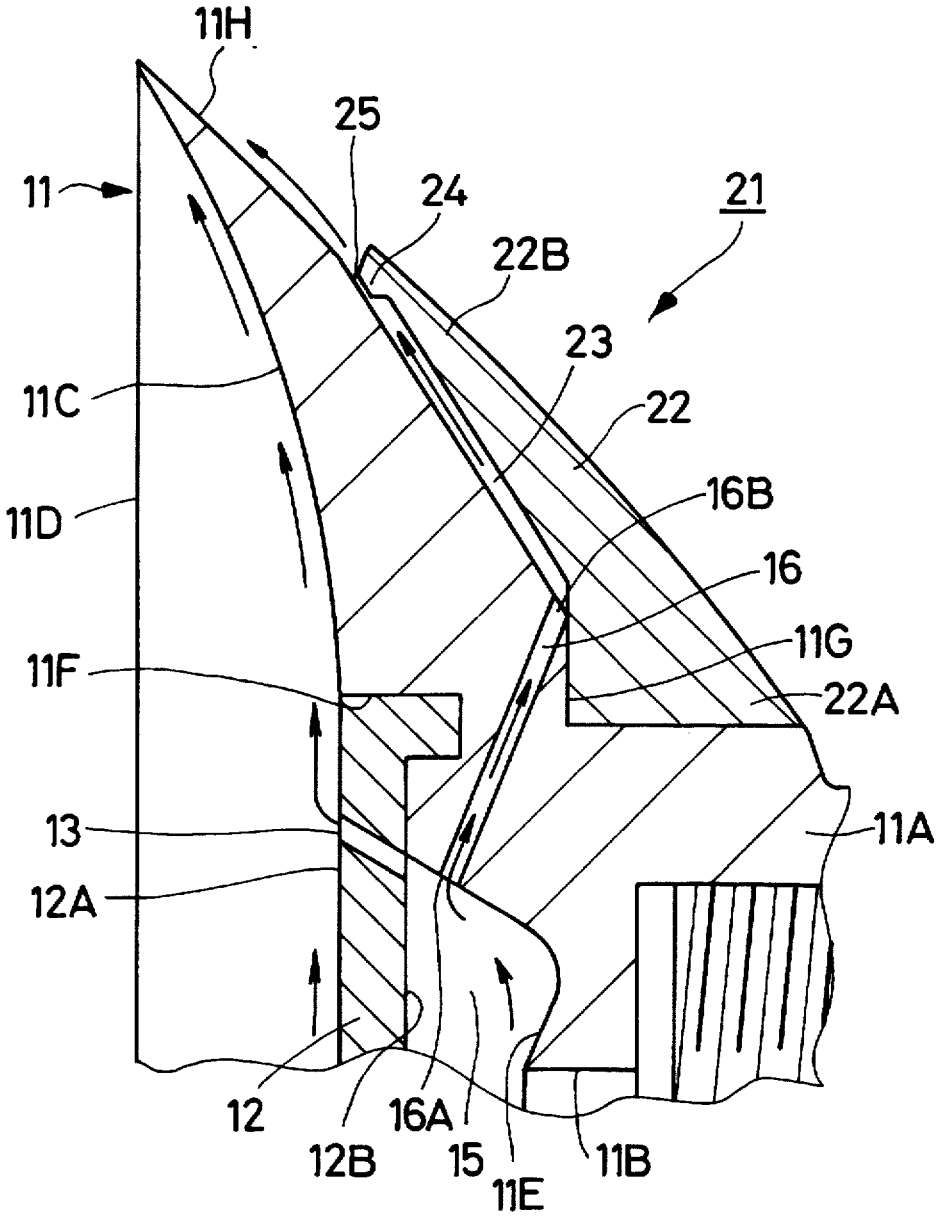
FIG. 5 is a longitudinal section of a rotary atomizing head assembly according to a second embodiment of the present invention.
Figure 6:
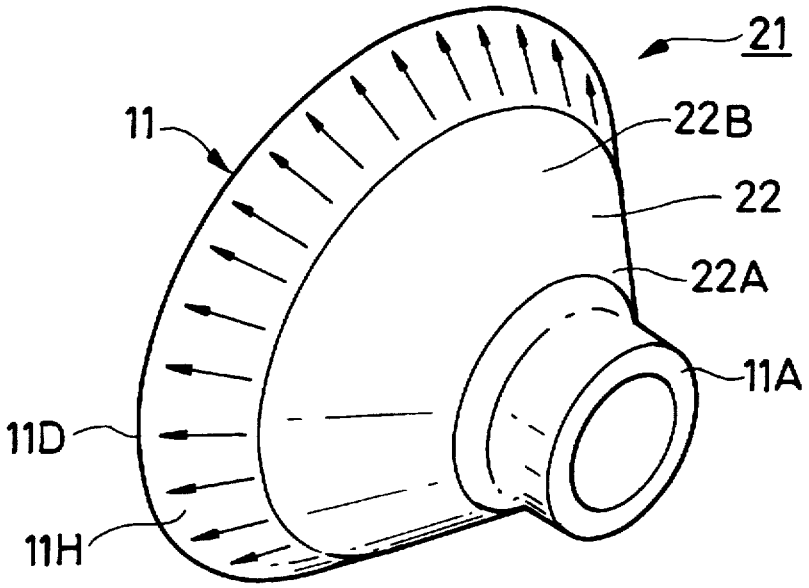
FIG. 6 is a perspective view of the rotary atomizing head assembly of the second embodiment, having a shower of thinner on outer peripheral surface of a bell cup for washing purposes.
Figure 7:
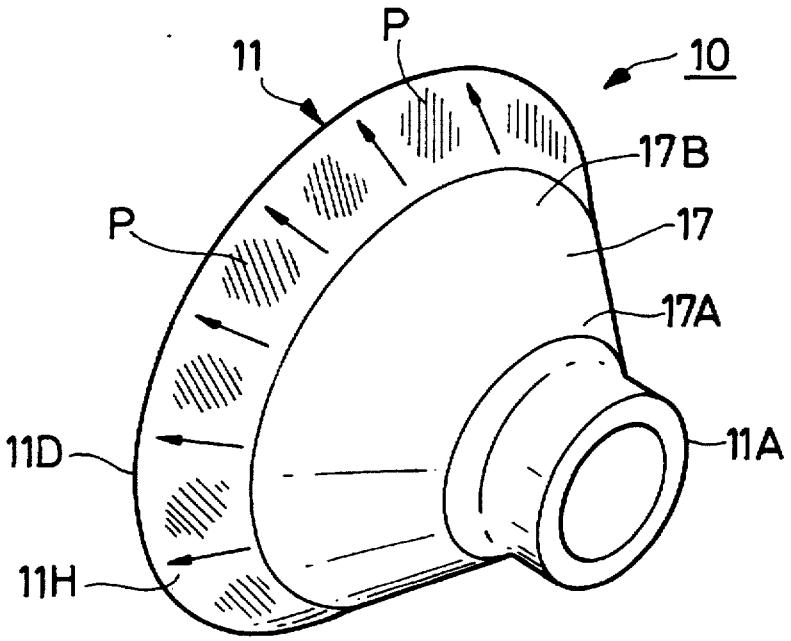
FIG. 7 is a perspective view of the rotary atomizing head assembly of the first embodiment, having a shower of thinner on outer peripheral surface of a bell cup similarly for washing purposes.

Referring now to FIGS. 5 to 7, there is shown a rotary atomizing head assembly according to a second embodiment of the present invention. This embodiment has a feature in that an annular ridge or protuberance is provided on the inner peripheral surface of the annular guide, the annular protuberance being projected toward the outer peripheral surface of the bell cup to form an annular constricted passage in cooperation with the outer peripheral surface of the bell cup. In the following description, except for the annular guide, the component parts which are same as the corresponding parts in the foregoing first embodiment are simply designated by common reference numerals or characters to avoid repetition of same explanations.

In FIG. 5, indicated at 21 is a rotary atomizing head assembly according to this second embodiment, employing an annular guide 22 which is securely fixed on a stepped mount portion 11G of the bell cup 11. The annular guide 22 is substantially same as the annular guide 17 of the first embodiment, and provided with a fitting base portion 22A and a enlarged front portion 22B which is in the shape of a bell or cup. The annular guide 22 is mounted on the bell cup 11 in such a way as to circumvent the outer peripheral side of the bell cup 11 in spaced relation with the bell cup 11. Therefore, a solvent diffusing chamber 23 is defined between the inner peripheral surface of the enlarged front portion 22B of the annular guide 22 and the outer peripheral surface 11H of the bell cup 11.

Indicated at 24 is an annular protuberance which is provided on the inner peripheral surface of the enlarged front portion 22B of the annular guide 22. This annular protuberance 24 is located at and along the fore end of the enlarged front portion 22B, and projected toward the outer peripheral surface 11H of the bell cup 11 from the inner peripheral surface of the enlarged front portion 22B. Further, the annular protuberance 24 is formed endlessly around the entire inner peripheral surface of the annular guide 22, forming an annular constricted passage 25 in cooperation with the outer peripheral surface 11H of the bell cup 11.

In this instance, at the time of washing the rotary atomizing head assembly 21, the annular protuberance 24 at the fore end of the enlarged front portion 22B of the annular guide 22 functions as a dam or weir for temporarily stopping the flow of the thinner, which has been supplied to the solvent diffusing chamber 23 through the exit openings 16B of the respective solvent passages 16 for circulation toward the fore end of the bell cup 11.

Having the construction just described, the rotary atomizing head assembly 21 of this embodiment operates basically in the same manner as the foregoing first embodiment at the time of a washing operation In the case of the rotary atomizing head assembly 21 of this embodiment, when it becomes necessary to wash off paint deposits of previous color on the rotary atomizing head assembly 21 at the time of changing the paint color, the rotary atomizing head assembly 21 is put in rotation by the air motor 2 while supplying thinner to the paint reservoir 15 through the solvent feed nozzle 6. The thinner which has been introduced into the paint reservoir 15 is allowed to flow into the respective paint outlet holes 13, solvent outlet holes 14 and solvent passages 16. Thus, paint deposits of previous color on the paint spreading surface 11C of the bell cup 11 are washed away with the thinner which flows out through the respective paint outlet holes 13, while paint deposits of previous color on the front face 12A of the hub member 12 are washed away with the thinner which flows out through the respective solvent outlet holes 14.

On the other hand, the thinner which has been passed through the solvent passages 16 is introduced into the paint diffusing chamber 23 from the exit openings 16B of the respective solvent passages 16. This portion of the thinner from the paint diffusing chamber 23 is urged to flow toward the fore end of the annular guide 22 under the guidance of the annular guide 22 and then comes into collision against the annular protuberance 24. As a result, the thinner is temporarily curbed by the weir effect of the annular protuberance 24 and spread over the entire circumference of the bell cup 11 in the paint diffusing chamber 23.

Then, after running over the annular protuberance 24 and flowing through the annular constricted passage 25, this part of the thinner is showered on the outer peripheral surface 11H of the bell cup 11. As a consequence, paint deposits on the outer peripheral surface 11H of the bell cup 11 can be completely washed away with the thinner from around the entire circumference of the latter.

FIG. 6 shows the rotary atomizing head assembly 21 of the present embodiment, in a perspective view taken obliquely from behind and above, the rotary atomizing head assembly 21 being in a phase of a washing operation in which a thinner is spurted out from the solvent feed nozzle 6 for two seconds. As seen in FIG. 6, paint deposits on the outer peripheral surface 11H of the bell cup 11 are completely washed away, without leaving any trace of paint deposits on the outer peripheral surface 11H. This is because, thanks to the dam or weir effects of the annular protuberance 24 on the annular guide 22, the thinner is spread over the outer peripheral surface 11H around the entire circumference of the bell cup 11 and, as indicated by arrows in FIG. 6, covering every part of the entire circumference of the bell cup 11.

On the other hand, FIG. 7 shows the rotary atomizing head assembly 10 of the first embodiment similarly in a perspective view taken from behind and above, the rotary atomizing head assembly 10 being in a phase of a washing operation in which a thinner is spurted out from the solvent feed nozzle 6 for the same time period of two seconds, similarly to the rotary atomizing head assembly 21 shown in FIG. 6. In this case, as seen in FIG. 7, part of paint deposits P (hatching parts) remains on the outer peripheral surface 11H of the bell cup 11. This occurs partly because of the absence of the annular protuberance on the annular guide 17 of the rotary atomizing head assembly 10 of the first embodiment and partly because of the thinner feed time of two seconds which is too short in this case to let the thinner spread over the entire circumferential surface of the bell cup 11 to a sufficient degree. Even in the case of the rotary atomizing head assembly 10 of the first embodiment, however, it is possible to wash paint deposits off the bell cup 11 to a sufficient degree by prolonging the thinner feed time to about five seconds, permitting the thinner within the solvent diffusing chamber 18 to spread over and around the entire circumference of the bell cup 11.

With the rotary atomizing head assembly 21 according to the present embodiment as described above, the performance of the washing operation can be enhanced all the more by providing the annular protuberance 24 on the inner peripheral surface of the annular guide 22, for higher reliability of washing job, shorter washing time and reduced thinner consumption.

Figure 8:
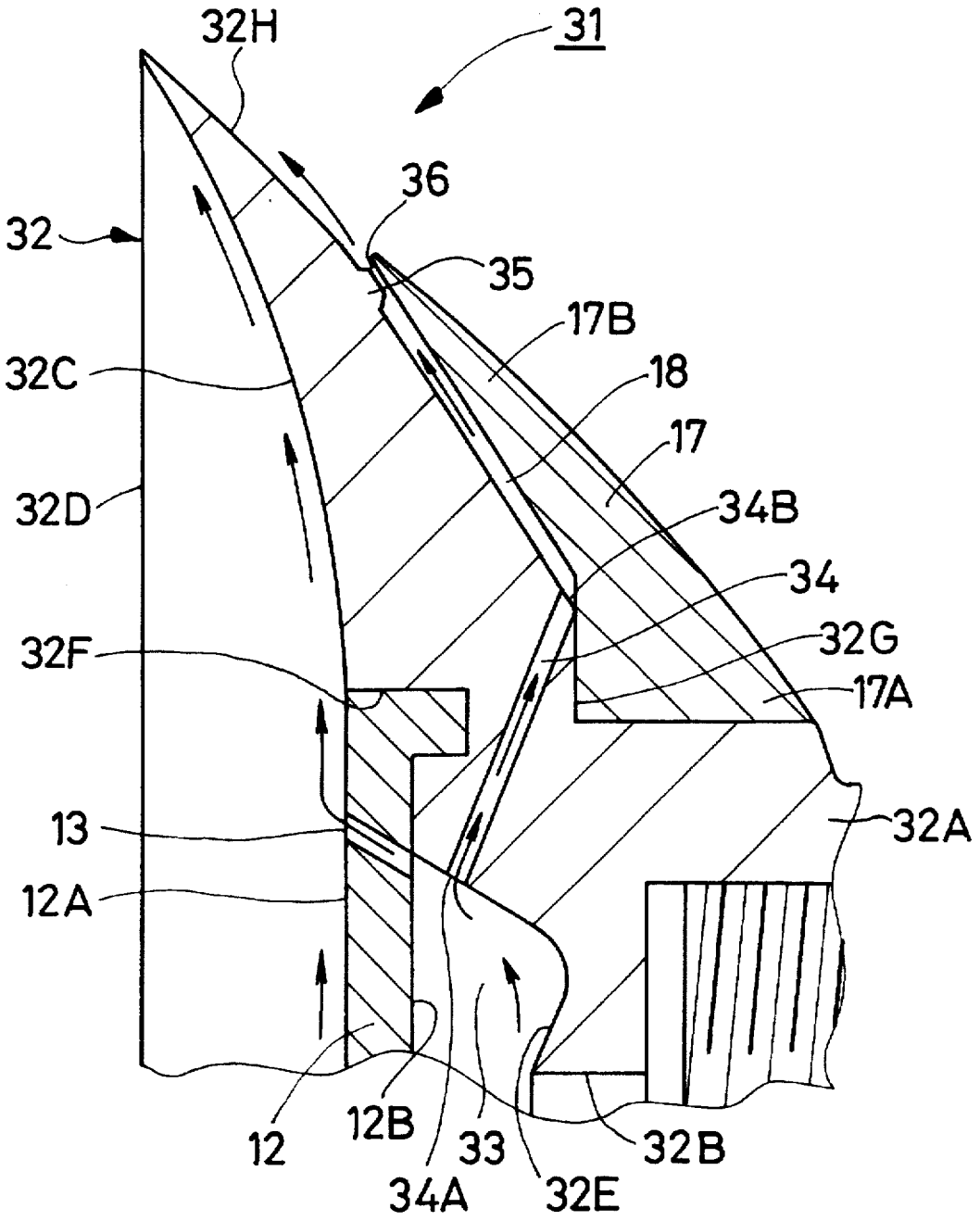
FIG. 8 is a longitudinal section through major components of a rotary atomizing head assembly according to a third embodiment of the present invention.

Illustrated in FIG. 8 is a rotary atomizing head assembly according to a third embodiment of the present invention. This embodiment is featured by an annular protuberance or ridge which is provided on the outer peripheral surface of the bell cup and projected toward the inner peripheral surface of the annular guide, and by an annular constricted passage which is formed between the annular protuberance and the outer peripheral surface of the bell cup. In the following description of the third embodiment, except for the bell cup, the component parts which are same as the corresponding parts of the above-described first embodiment are simply designated by common reference numerals or characters to avoid repetition of same explanations.

Indicated at 31 is a rotary atomizing head assembly according to the present embodiment, and at 32 is a bell cup which defines the outer configuration of the rotary atomizing head assembly 31. The bell cup 32 is formed in a bell- or cup-like shape, and largely constituted by a fitting base portion 32A to be mounted on a rotational shaft, passage hole 32B, paint spreading surface 32C for distributing a paint in the form of a thin film, paint releasing edge 32D, paint receiving surface 32E, hub mounting groove 32F, stepped mount portion 32G and outer peripheral surface 32H.

A hub member 12 is fitted in the hub mounting groove 32F of the bell cup 32, defining a paint reservoir 33 between a paint receiving surface 12B of the hub member 12 and the paint receiving surface 32E on the part of the bell cup 32.

Further, similarly to the above-described first embodiment, the bell cup 32 is formed with a plural number of solvent passages 34 having the respective entrance and exit openings 34A and 34B opened on the paint receiving surface 32E and the outer peripheral surface 32H of the of the bell cup 32, respectively. Further, an annular guide 17 is fitted on the stepped mount portion 32G of the bell cup 32, defining a solvent diffusing chamber 18 between the outer peripheral surface 32H of the bell cup 32 and the inner peripheral surface of the enlarged front portion 17B of the annular guide 17.

The present embodiment is identical with the above-described first embodiment in these aspects but differs from the bell cup 11 in that an annular protuberance 35 is provided on the part of the outer peripheral surface 32H of the bell cup 32. More specifically, in the present embodiment, an annular protuberance 35 is provided on the outer peripheral surface 32H of the bell cup 32 in such a position as to confront fore end portions of the enlarged front portion 17G of the annular guide 17. The annular protuberance 35 is formed endlessly around the entire circumference of the bell cup 32, and a constricted annular passage 36 is formed between the annular protuberance 35 and the enlarged front portion 17B of the annular guide 17.

In this instance, the annular protuberance 35 at the fore end of the annular guide 17 similarly functions as a dam or weir for temporarily stopping the flow of thinner which is introduced into the solvent diffusing chamber 18 through the exit opening 34B of the respective solvent passages 34 for distribution toward the fore end of the bell cup 32.

With the arrangements just described, the rotary atomizing head assembly 31 of this embodiment can be washed in a reliable manner within a shortened time period and by the use of a smaller amount of thinner as in the foregoing first embodiment.

Figure 9:
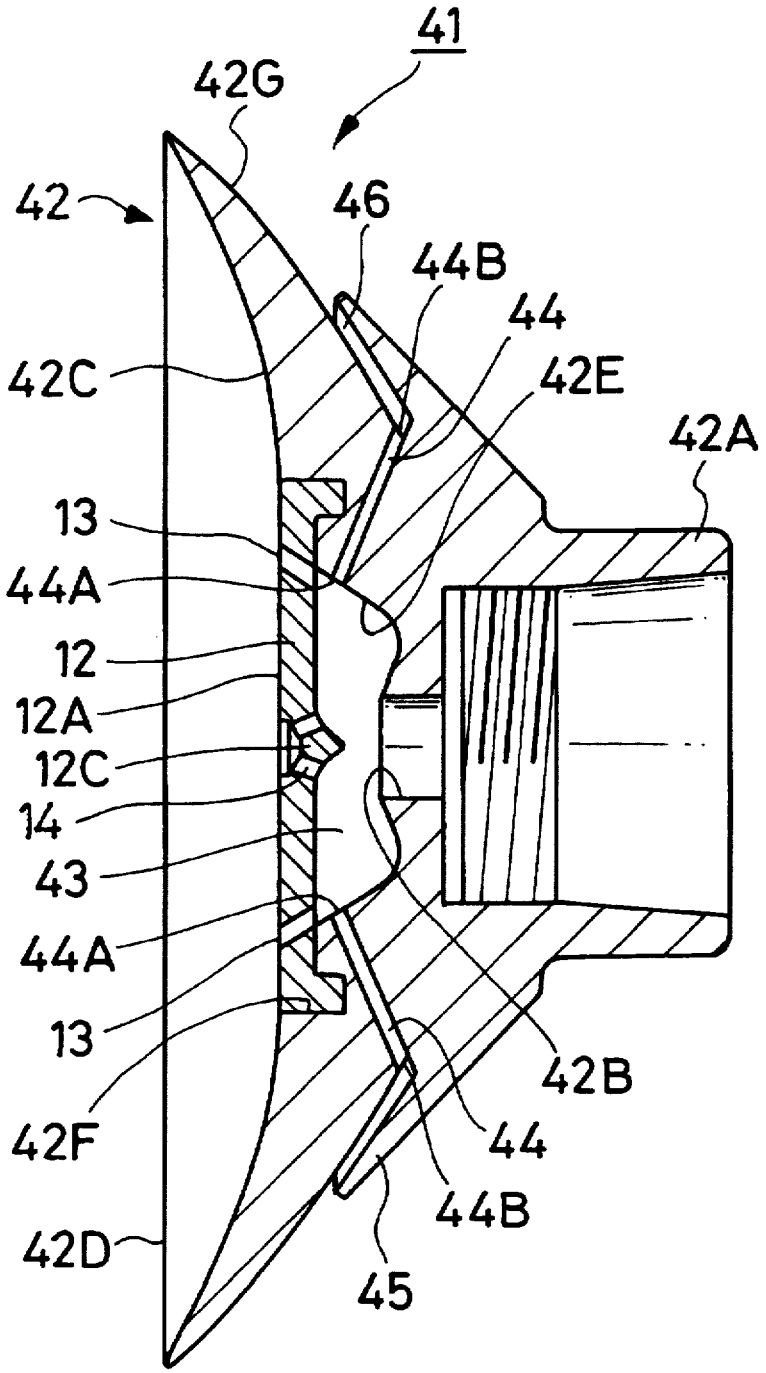
FIG. 9 is a longitudinal section of a rotary atomizing head assembly according to a fourth embodiment of the present invention.

Referring now to FIG. 9, there is shown a rotary atomizing head assembly according to a fourth embodiment of the present invention. This embodiment is featured by an annular guide which is formed integrally around the outer peripheral side of a bell cup. In the following description of the fourth embodiment, the components such as hub member, paint outlet holes and solvent outlet holes, which are identical with the counterparts in the foregoing first embodiment, are simply designated by similar reference numerals or characters to avoid repetitions of same explanations.

Indicated at 41 is a rotary atomizing head assembly according to the present embodiment, and at 42 is a bell cup which defines the outer configuration of the rotary atomizing head assembly 41. In the same manner as in the first embodiment, the bell cup 42 is formed in a bell- or cup-like shape, and constituted by fitting base portion 42A to be mounted on a rotational shaft, passage hole 42B, paint spreading surface 42C for spreading a paint into a thin filmy form, paint releasing edge 42D, paint receiving surface 42E, hub mounting groove 42F, and outer peripheral surface 42G. A hub member 12 is mounted in the hub mounting groove 42F, defining a paint reservoir 43 between the paint supply surface 12B of the hub member 12 and paint receiving surface 42E of the bell cup 42.

Denoted at 44 are a number of solvent passages, for example, twelve solvent passages which are provided at predetermined intervals in the circumferential direction of the bell cup 42. Similarly to the solvent passages 16 of the first embodiment, these solvent passages 44 similarly have the entrance openings 44A opened to the paint reservoir 43 and the exit openings 44B opened on the outer peripheral surface 42G of the bell cup 42.

Designated at 45 is an annular guide which is provided in an axially intermediate position on the outer peripheral side of the bell cup 42. This annular guide 45 is substantially in the same shape as the above-described annular guide 17 of the first embodiment, except that the annular guide 45 is formed integrally with the bell cup 42. A solvent diffusing chamber 46 is formed between the outer peripheral surface 42G of the bell cup 42 and the inner peripheral surface of the annular guide 45.

With the arrangements just described, the rotary atomizing head assembly 41 of the present embodiment can produce substantially the same operational effects as the foregoing first embodiment. Especially, it becomes possible to reduce the number of parts in this case, by the use of the annular guide 45 which is formed integrally with the bell cup 42.

Figure 10:
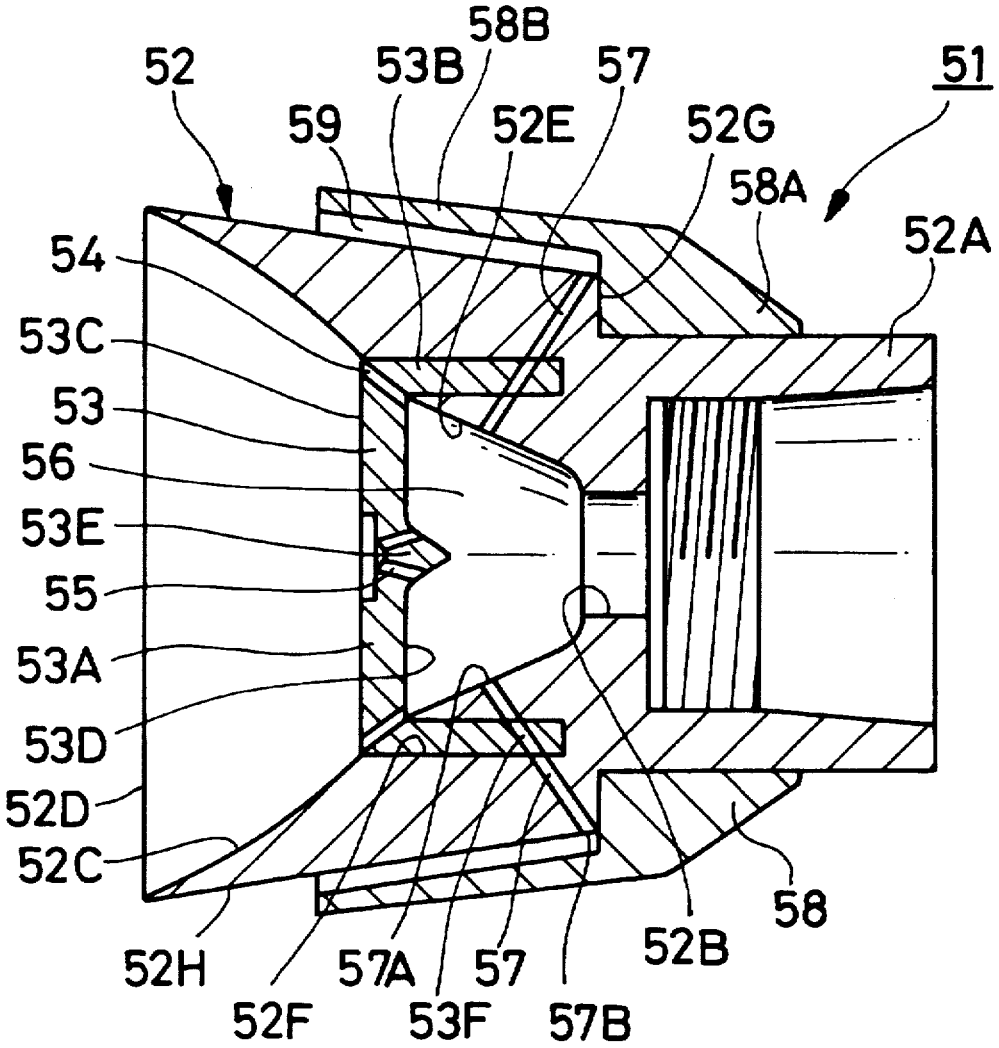
FIG. 10 is a longitudinal section of a rotary atomizing head assembly according to a fifth embodiment of the present invention.

Referring now to FIG. 10, there is shown a rotary atomizing head assembly according to a fifth embodiment of the present invention. This embodiment is featured by a bell cup which is formed in an oblong or almost cylindrical shape in its enlarged front portion and provided with a plural number of solvent passages along with an annular guide.

More specifically, indicated at 51 is a rotary atomizing head assembly according to the present embodiment, and at 52 is a bell cup which defines the outer configuration of the rotary atomizing head assembly 51. The bell cup 52 is formed in a bell- or cup-like shape, and includes, similarly to the bell cup 11 of the above-described first embodiment, fitting base portion 52A to be mounted on a rotational shaft, passage hole 52B, paint spreading surface 52C for spreading a paint into a thin filmy form, paint releasing edge 52D, paint receiving surface 52E, hub mounting groove 52F, stepped mount portion 52G, and outer peripheral surface 52H. In this case, however, the bell cup 52 differs from the bell cup 11 of the first embodiment in that it is formed in an oblong shape in its enlarged front portion, presenting an almost cylindrical shape as a whole.

Denoted at 53 is a hub member which is fitted in the hub mounting groove 52F of the bell cup 52 and which is constituted by a disc portion 53A of circular shape and a cylindrical anchor portion 53B. The disc portion 53A is provided with a flat face 53C and a paint supply surface 53D on its front and rear sides, respectively.

Further, the hub member 53 is provided with a plural number of paint outlet holes 54 which are arranged circularly in and along boundaries between its disc portion 53A and cylindrical portion 53B, along with a conical projection 53E which is formed centrally of the disc portion 53A. A plural number of solvent outlet holes 55 are formed around foot portions of the conical projection 53E.

Furthermore, the hub member 53 is fitted in the hub mounting groove 52F of the bell cup 52 in such a way as to define a paint reservoir 56 between its paint supply surface 53 and the paint receiving surface 52E of the bell cup 52.

Indicated at 57 are a plural number of solvent passages, for example, twelve solvent passages which are provided at intervals in the circumferential direction of the bell cup 52. These solvent passages 57 have the respective entrance openings 57A opened on the paint receiving surface 52E and the respective exit openings 57B opened on the outer peripheral surface 52H of the bell cup 52. Intermediate portions of the solvent passages 57 are bored across the walls of the cylindrical portion 53B of the hub member 53. Namely, the cylindrical portion 53B of the hub member 53 is provided with intercommunicating bores 53F which constitute part of the solvent passages 57.

Denoted at 58 is an annular guide which is fitted on the stepped mount portion 52G of the bell cup 52. The annular guide 58 includes fitting base portion 58A and a enlarged front portion 58B which extends forwardly along the outer peripheral surface 52H of the bell cup 52, surrounding the bell cup 52 in spaced relation therewith. A solvent diffusing chamber 59 is formed between the outer peripheral surface 52H of the bell cup 52 and the inner peripheral surface of the enlarged front portion 58B of the annular guide 58.

With the arrangements just described, the rotary atomizing head assembly 51 of the present embodiment can produce the same operational effects as in the foregoing first embodiment.

Figure 11:
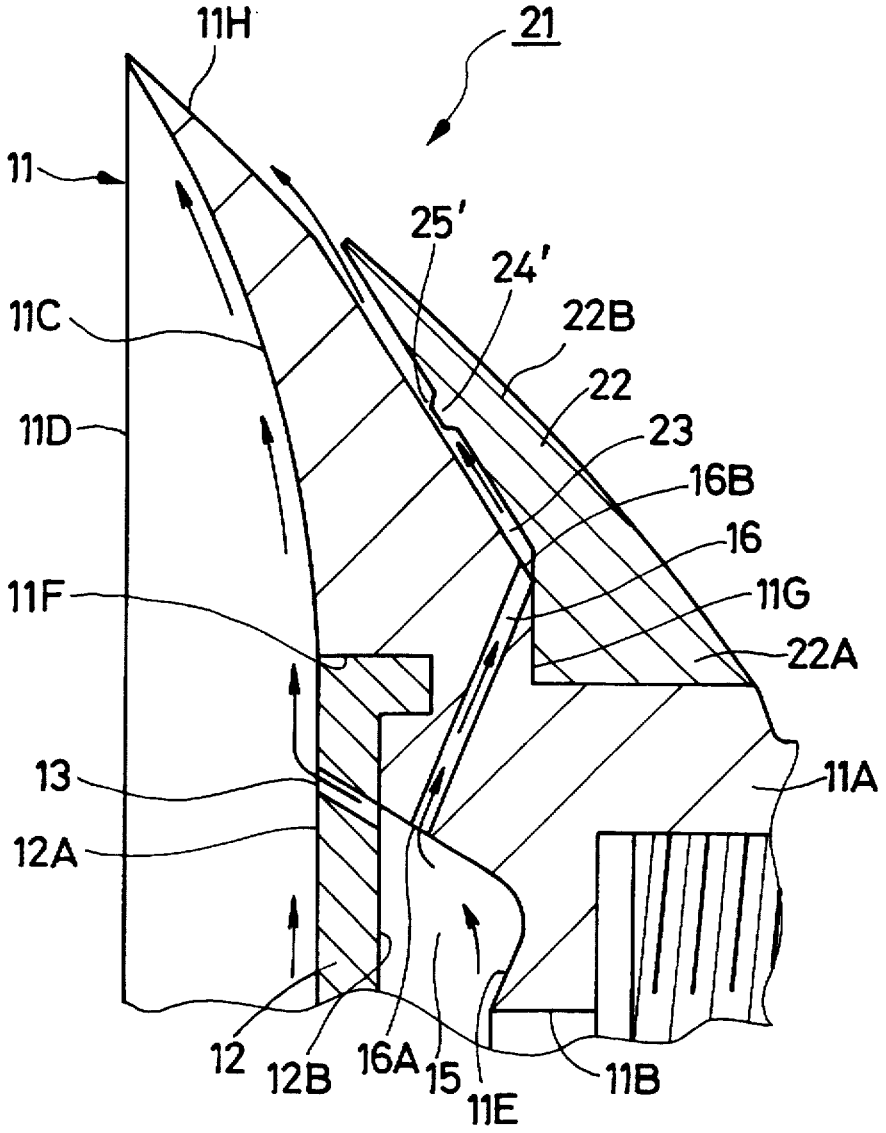
FIG. 11 is a longitudinal section through major components of a modification of the rotary atomizing head assembly of the second embodiment, having an annular protuberance provided in an axially intermediate portion of an annular guide.

In the above-described second embodiment, the annular protuberance 24 has been described as being provided at and along the fore end of the enlarged front portion 22B of the annular guide 22 as shown in FIG. 5. However, the present invention is not restricted to this particular arrangement, and includes other arrangements in which the annular protuberance is located in an axially intermediate position or in a rear position on the inner peripheral surface of the enlarged front portion 22B of the annular guide 22. More specifically, as in a modification shown in FIG. 11, an annular protuberance 24' may be provided in an axially intermediate position on the annular guide 22.

Figure 12:
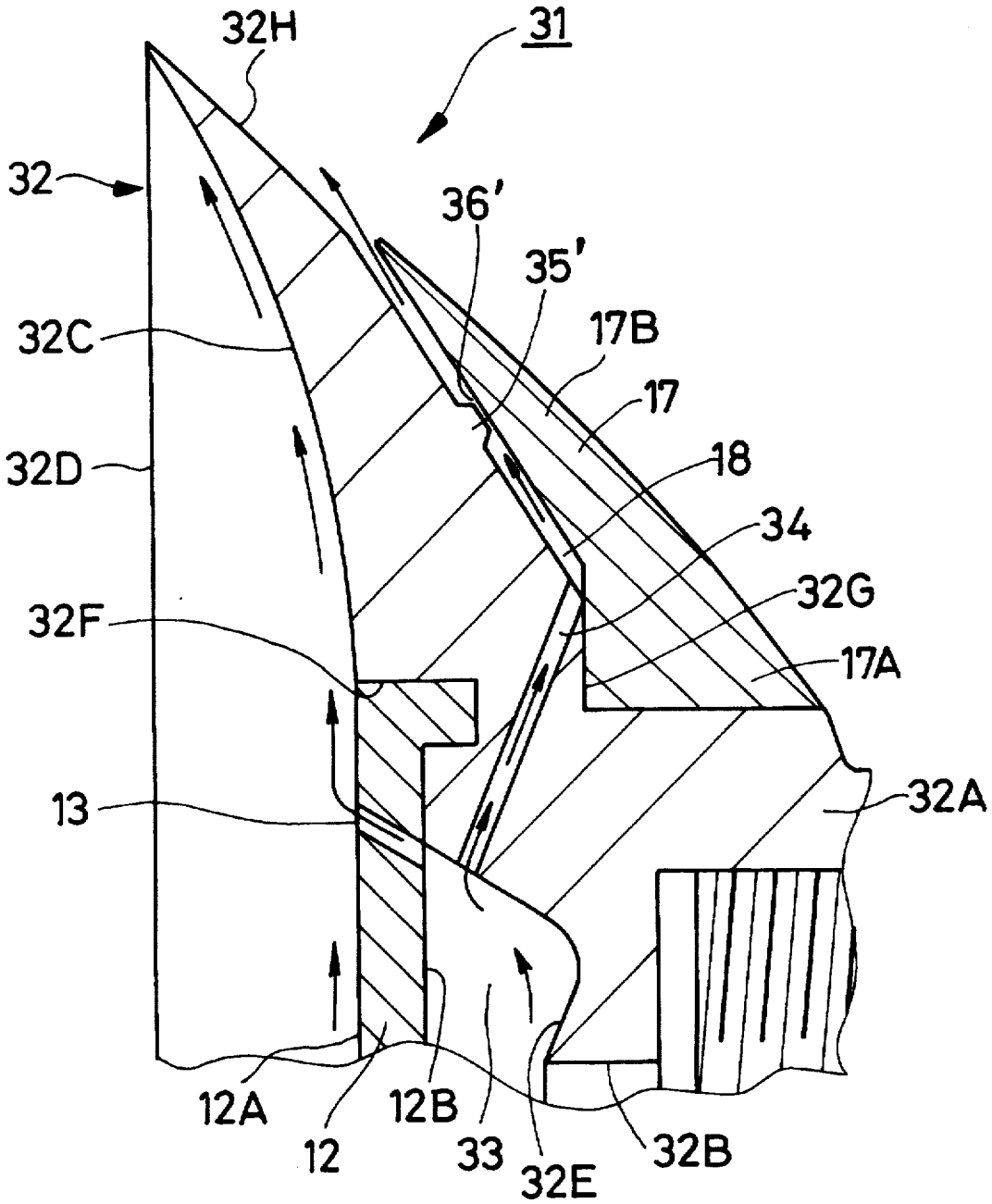
FIG. 12 is a longitudinal section through major components of a modification of the rotary atomizing head assembly of the third embodiment, having an annular protuberance provided on the part of a bell cup in face to face relation with an axially intermediate portion of an annular guide

Further, in the foregoing third embodiment of the present invention, the annular protuberance 35 has been described as being located in such a position on the outer peripheral surface 32H of the bell cup 32 as to confront face to face with a fore end portion of the enlarged front portion 17B of the annular guide 17 as shown in FIG. 8. However, the present invention is not restricted to this particular arrangement, and includes other arrangements in which the annular protuberance is located in an axially intermediate position or in a rear portion on the enlarged front portion 17B of the annular guide 17. More specifically, as in a modification shown in FIG. 12, an annular protuberance 35' may be provided in such a position as to confront an axially intermediate portion of the annular guide 17.

Furthermore, in the foregoing embodiments, the rotary atomizing head assembly according to the present invention has been described by way of a center feed type electrostatic coating machine having the paint and solvent feed nozzles 5 and 6 within the hollow rotational shaft 3. However, it is to be understood that the present invention can be applied to other types of electrostatic coating machines adapted to spurt paint and thinner into a rotary atomizing head assembly from a paint feed pipe and a solvent feed pipe which are provided externally of a rotational shaft.

Industrial Applicability

As clear from the foregoing particular description, the rotary atomizing head assembly according to the present invention is provided with a plural number of solvent passages which communicate a paint reservoir in a bell cup with the outer peripheral side of the bell cup, along with an annular guide which is mounted in such a way as to surround the outer peripheral surface of the bell cup in spaced relation with the inner peripheral surface of the annular guide to define a solvent diffusing chamber therebetween. Therefore, a solvent, which is supplied to the paint reservoir from a nozzle at the time of washing the rotary atomizing head assembly, is introduced into the solvent diffusing chamber through the respective solvent passages and showered on the outer peripheral surface of the bell cup, thereby permitting to wash away paint deposits from the outer peripheral surface of the bell cup in an assured manner.

In addition, the solvent, which flows out to the outer peripheral side of the bell cup through the respective solvent passages, is temporarily pooled in the solvent diffusing chamber and then allowed to flow toward the fore end of the bell cup, thereby utilizing the entire amount of effluent solvent from the respective solvent passages effectively and economically in washing outer peripheral surface of the bell cup. Thus, the present invention makes it possible to use the solvent more efficiently and to enhance the efficiency of washing operations to a marked degree

We claim:

1. A rotary atomizing head assembly for paint coating machine including;

a bell cup formed in a bell- or cup-shape, said bell cup having a paint spreading surface in a front portion of inner peripheral surface thereof for spreading a paint into a thin filmy form and a paint receiving surface in a rear portion of said inner peripheral surface;

a hub member mounted on the inner peripheral side of said bell cup between said paint spreading surface and said paint receiving surface;

a paint reservoir formed between a rear surface of said hub member and said paint receiving surface of said bell cup for holding a supply of paint or solvent received from a nozzle provided on coating machine body;

and a plural number of paint outlet holes provided in said hub member for letting said paint or solvent flow out from said paint reservoir to said paint spreading surface of said bell cup;

characterized in that said rotary atomizing head assembly comprises;

a plural number of solvent passages having respective entrance and exit openings located on the inner and outer peripheral surfaces of said bell cup,-respectively, to communicate said paint reservoir with outer peripheral side of said bell cup;

an annular guide mounted around said bell cup in spaced relation with the outer peripheral side of said bell cup to guide effluent solvent coming out of said exit openings of said solvent passages; and a solvent diffusing chamber formed between and around inner peripheral surface of said annular guide and outer peripheral surface of said bell cup to diffuse said solvent supplied from said solvent passages.

2. A rotary atomizing head assembly as defined in claim 1, further comprising an annular protuberance provided in said solvent diffusing chamber between inner peripheral surface of said annular guide and outer peripheral surface of said bell cup for diffusing flow of said solvent within said solvent diffusing chamber.

3. A rotary atomizing head assembly as defined in claim 1, further comprising an annular protuberance provided on inner peripheral surface of said annular guide and projected toward outer peripheral surface of said bell cup to form an annular constricted passage between said annular guide and said bell cup.

4. A rotary atomizing head assembly as defined in claim 1, further comprising an annular protuberance provided on outer peripheral surface of said bell cup and projected toward inner peripheral surface of said annular guide to form an annular constricted passage between said annular guide and said bell cup.

5. A rotary atomizing head assembly as defined in claim 1, wherein said entrance openings of said solvent passages are located in positions inwardly spaced from said paint outlet holes by a predetermined distance.

6. A rotary atomizing head assembly as defined in claim 1, wherein said solvent passages are inclined in rotational direction of said bell cup gradually from said entrance openings toward said exit openings thereof.

7. A rotary atomizing head assembly as defined in claim 1, wherein said solvent passages are inclined in a rearward direction of said bell cup gradually from said entrance openings toward said exit openings.

* * * * *

UNITED STATES PATENT AND TRADEMARK OFFICE

CERTIFICATE OF CORRECTION

PATENT NO. : 5,894,993

DATED : April 20, 1999

INVENTOR(S): Shinichi TAKAYAMA, et al.

It is certified that an error appears in the above-identified patent and that said Letters Patent is hereby corrected as shown below:

On the Title page, item [54], and on top of column 1, the title should be:

--[54] ROTARY ATOMIZING HEAD ASSEMBLY--

Signed and Sealed this

Twenty-fifth Day of January, 2000

*Attest:*

*Attesting Officer*

*Acting Commissioner of Patents and Trademarks*